United States Patent [19]

Bodocsi et al.

[11] 3,971,179

[45] July 27, 1976

[54] NON-BONDED FRAMING SYSTEM

[76] Inventors: Andrew Bodocsi; John H. Hoge; John H. Hubbard; S. Jackson Hubbard; Gerard Roberto, all of 4204 Airport Road, Cincinnati, Ohio 45226

[22] Filed: Mar. 2, 1971

[21] Appl. No.: 120,123

Related U.S. Application Data

[63] Continuation-in-part of Ser. No. 849,787, Aug. 13, 1969, abandoned.

[52] U.S. Cl. ..... 52/223 R; 52/640; 52/272

[51] Int. Cl.[2] ..... E04C 3/10; E04B 1/06

[58] Field of Search ..... 287/189.36 R, 189.36 A, 287/189.36 B, 189.36 F, 20.92; 5/288; 52/640, 586, 588, 272, 283, 274, 573, 721, 288, 223–230, 582

[56] References Cited

UNITED STATES PATENTS

| | | | |
|---|---|---|---|
| 1,024,852 | 4/1912 | Holmberg | 52/283 |
| 1,662,768 | 3/1928 | Wait | 287/189.36 |
| 2,019,684 | 11/1935 | Leake | 287/189.36 |
| 2,195,611 | 4/1940 | Brown | 287/189.36 |
| 2,555,782 | 6/1951 | Brownstein | 52/646 |
| 2,569,669 | 10/1951 | Henderson | 52/283 |
| 2,744,795 | 5/1956 | McDonough | 52/288 |
| 3,070,845 | 1/1963 | Cheskin | 52/223 |
| 3,269,069 | 10/1966 | Carlson | 52/573 |
| 3,295,280 | 1/1967 | Kettner | 52/573 |
| 3,295,288 | 1/1967 | Bakke et al. | 52/721 |

FOREIGN PATENTS OR APPLICATIONS

| | | | |
|---|---|---|---|
| 96,982 | 5/1924 | Austria | 5/288 |
| 928,623 | 6/1947 | France | 52/640 |
| 121,365 | 10/1918 | United Kingdom | 5/288 |

*Primary Examiner*—Ernest R. Purser
*Assistant Examiner*—James L. Ridgill, Jr.
*Attorney, Agent, or Firm*—Melville, Strasser, Foster & Hoffman

[57] ABSTRACT

An improved non-bonded framing system in two- and three-dimensional configurations which is rendered capable of rigid frame action by actuation of force-displacement means in specified connections between joined frame members so that controlled force-couples are introduced in the connections whereby strain energy is stored in the system and the connections are locked and rendered rigid and capable of immediate moment transfer prior to application of vertical and horizontal service loads to the framing system.

14 Claims, 28 Drawing Figures

INVENTOR/S
ANDREW BODOCSI
JOHN H. HOGE, JOHN H. HUBBARD
S. JACKSON HUBBARD
GERARD ROBERTO

BY Melville, Strasser, Foster and Hoffman
ATTORNEYS

INVENTOR/S
ANDREW BODOCSI
JOHN H. HOGE, JOHN H. HUBBARD
S. JACKSON HUBBARD
GERARD ROBERTO

BY Melville, Strasser, Foster and Hoffman
ATTORNEYS

INVENTOR/S
ANDREW BODOCSI
JOHN H. HOGE, JOHN H. HUBBARD
S. JACKSON HUBBARD
GERARD ROBERTO

BY Melville, Strasser, Foster and Hoffman
ATTORNEYS

INVENTOR/S
ANDREW BODOCSI
JOHN H. HOGE, JOHN H. HUBBARD
S. JACKSON HUBBARD
GERARD ROBERTO
BY Melville, Strasser, Foster and Hoffman
ATTORNEYS INVENTOR/S
ANDREW BODOCSI
JOHN H. HOGE, JOHN H. HUBBARD
S. JACKSON HUBBARD
GERARD ROBERTO
BY Melville, Strasser, Foster and Hoffman
ATTORNEYS INVENTOR/S
ANDREW BODOCSI
JOHN H. HOGE, JOHN H. HUBBARD
S. JACKSON HUBBARD
GERARD ROBERTO
BY Melville, Strasser, Foster and Hoffman
ATTORNEYS INVENTOR/S
ANDREW BODOCSI,
JOHN H. HOGE, JOHN H. HUBBARD,
S. JACKSON HUBBARD
GERARD ROBERTO
BY Melville, Strasser, Foster and Hoffman
ATTORNEYS INVENTOR/S
ANDREW BODOCSI, JOHN H. HOGE, JOHN H. HUBBARD, S. JACKSON HUBBARD, GERARD ROBERTO.

BY Melville, Strasser, Foster and Hoffman
ATTORNEYS

INVENTOR/S
ANDREW BODOCSI, JOHN H. HOGE,
JOHN H. HUBBARD,
S. JACKSON HUBBARD,
GERARD ROBERTO.
BY Melville, Strasser, Foster and Hoffman
ATTORNEYS INVENTOR/S
ANDREW BODOCSI,
JOHN H. HOGE, JOHN H. HUBBARD
S. JACKSON HUBBARD,
GERARD ROBERTO.
BY Melville, Strasser, Foster and Hoffman
ATTORNEYS

T- (TORQUE APPLIED TO CONNECTING TENSION BOLTS IN FOOT-POUNDS)

INVENTOR/S
ANDREW BODOCSI,
JOHN H. HOGE, JOHN H. HUBBARD
S. JACKSON HUBBARD,
GERARD ROBERTO
BY Melville, Strasser, Foster and Hoffman
ATTORNEYS

NON-BONDED FRAMING SYSTEM

CROSS-REFERENCES TO RELATED APPLICATION

This application is a continuation-in-part of application Ser. No. 849,787, filed Aug. 13, 1969, now abandoned, in the names of Bodocsi, Hoge, Hubbard, Hubbard and Roberto.

BACKGROUND OF THE INVENTION

1. Field of the Invention

This invention relates to rigid framing systems, and more particularly to framing systems achieving rigid frame action by use of non-bonded connections.

2. Description of the Prior Art

Frame rigidity is desirable because it facilitates economy of materials, simplicity of configuration and physical stability in the support of horizontal and vertical service loadings.

A principal requirement for rigid frame action is rigid connections that are capable of immediate moment transfer upon application of service loads. The majority of such connections are of the bonded type, such as welding of metals, monolithic casting of concretes, and the use of adhesives, as with wood. Such connections are non-adjustable and require close quality control to insure integration of connected members.

Non-bonded connections and fastening assemblies presently used in forming frames vary in their rigidities, the degree of rigidity being inversely proportional to the amount of non-moment transferring rotation in the joints. Most non-bonded joints require widely varying amounts of rotation before they function in full moment transfer and the connections thereof are non-adjustable.

Non-bonded connections usually employ mechanical fasteners, such as unfinished bolts, hot or cold driven rivets, high strength bolts, nails, screws, and other special connectors. The imperfect fit between the unfinished bolts or rivets and their respective holes results in unreliable moment transferring connections. The same applies to all connections between wood members, where the fit between connectors or fastening assemblies and the wood are subject to degradation, mainly due to the shrinkage and deformation of the wood. Though non-bonded connections simplify assembly and disassembly of frames, they lack the capability of adhesives for rigidly joining unlike materials and shapes.

Generally, the degree of rigidity and the functioning of prior art connections using mechanical fasteners is sensitive to the proper fit of connectors, and also to the proper alignment of members and a multiplicity of connector elements. Improper alignment may cause prying action in the joint which tends to reduce joint rigidity, especially in the so-called friction-type bolt connections using high strength bolts. Prior art non-bonded connections are usually quite cumbersome and bulky, and require a considerable degree of precision in fabrication and assembly of complex elements and frame members.

Close tolerance in fabrication is more difficult to attain with precast concrete than with wood or metals, and the degree of connection and frame rigidity attained in non-bonded concrete frames leaves much to be desired. For example, Canadian Letters Pat. No. 467,791, in the name of Albert Henderson, teaches a modular system of standardized structural members intended to insure more exact positioning or space relation of the elements of his connections. Brackets are provided to seat the beams, and for shear support, and the need for high tensioning of the bolts of the friction-type connection is emphasized. However, the bolts pass through steel pipe sleeves set in the concrete members and welded to their reinforcing bars, the sleeves being specified as having a 2 inch diameter. The loose fit inevitable from such tolerance will cause a loss of joint rigidity and is typical of connections for precast concrete. U.S. Pat. No. 3,495,371, in the name of N. B. Mitchell, Jr., discloses another approach to precast concrete connections wherein the beam members are clamped into steel crotches or troughs fabricated on the column tops. Here, too, joint rigidity is adversely affected by the loose fit of the tension bolts in the sleeves and holes, and by any unevenness of the faces of the concrete beams where they adjoin the faces of the steel trough. Conventional bolted connections are specified for beams at right angles to the moment transfer connections, so that these frame structures could be rigid in only one direction.

The structural uses and advantages of camber and prestressing are well understood. These features are usually incorporated in the structural members during fabrication and cannot thereafter be adjusted. U.S. Pat. No. 2,626,688, in the name of A. S. T. Lagaard, however, teaches the use of co-acting spacers in the top chord of joists for limited field adjustment of chamber prior to application of service loads. The use of prefabricated tensioning and camber generally has no bearing on the rigidity of the connections when the members are assembled into frame structures.

U.S. Pat. No. 3,070,845, in the name of D. B. Cheskin, discloses a pre-stressed connection for joining a series of beams into a continuous beam while imparting tension and camber into the component beams. The continuous beam is supported on columns, but the specified connections do not engage the columns, or other beams at right angles to the continuous beam, in the moment transfer condition necessary for rigid frame action. Addtionally, a second bolt or set of bolts is required at each connection to anchor each beam to its supporting columns, but once secured, such anchor bolt resists the relative rotation of the beam members in a manner that limits the stated objectives of tensioning and cambering. Cheskin discloses one alternative design of connection in FIG. 8 (to provide for tensioning of an end beam from both ends) which could be capable of moment transfer between the beam and the column, but this design can be used only on the outermost columns of a series, providing a limited contribution to the rigid frame action of the structure along only one of the two axes of the building. It should be emphasized that Cheskin does not mention frame rigidity nor multispan rigid frames in two- and three-dimensional configurations. In addition, the configuration of the specificed connections limits their practical usefulness to one story structures.

SUMMARY OF THE INVENTION

The present invention provides an improved framing system for two- and three-dimensional configurations which achieves rigid frame action by use of novel non-bonded connections that cause the connected flexural members of the frame to interact as levers by provision of common fulcrums and force-displacement means in specified connections. The actuation of the force-displacement devices produces a controlled force-couple in the connections, causing a relative rotation of the joined flexural members which is restrained by the connections or anchorages at their other ends. This stores strain energy in the system, locking the connections and frame rigid and capable of immediate moment transfer prior to application of vetical and horizontal service loads.

When the framing system is extended for two- and three-dimensional configurations, each frame usually has one flexural member in common with each frame adjacent to it. Nevertheless, each frame in the system is itself rendered rigid by its own connections, and its own rigidity is not significantly affected by the addition or removal of adjacent frames, since the rigidity of each frame can be controlled and adjusted during or after assembly and loading.

The means for effecting and controlling the interaction of the flexural members of a typical non-bonded rigid frame of this invention can be seen in FIG. 1, which is a side elevational view of a typical rigid frame of the present invention utilizing non-bonded connections. There a pair of horizontal flexural members 10 and 12, which may be called beams, are joined to a pair of vertical flexural members 14 and 16, which may be called columns. In this typical embodiment, the connecting means that form the fulcrums are the lower flange 12*a* of the beam 12, resulting from the bevel cut of the beam ends 12*b* and 12*c*, and the protruding plates 18, which are welded to the bottom flange 10*a* of each end 10*b* and 10*c* of the beam 10. The engagement of the protruding plates 18 and the beam ends 12*a* at any suitable or desired point on the inward faces 14*a* and 16*a* of the columns 14 and 16, respectively, produces the required common fulcrums and permits relative rotation of the joined members. The upper flanges 10 *d* and 12*d* of the beams 10 andd 12, respectively, have at least one threaded rod 20 welded to their undersides, the threaded portions of the rods 20 extending far enough beyond the ends of the beams 10 and 12 to pass through the holes 22 which are provided in the inner faces 14*a* and 16*a* of the column members 14 and 16, respectively, and permit full engagement with the nuts 24. Tightening of the nuts 24 brings the joined members into bearing contact at their common fulcrums. Further tightening of the nuts 24 causes the nuts to act as force displacement devices, producing a force couple in each respective connection that causes relative rotation of the joined faces of the connected members at that connection about their common fulcrums. This rotation is resisted by the connections at the other ends of each member, so that the members become locked into a rigid framing system. Tis stored strain energy forces the connected members together into a rigid framing system and creates and maintains tight connections capable of immediate transfer of moments upon the application of horizontal and vertical service loads. The amount of bending strain energy thereby stored in the system is controllable by the magnitude of force-displacement introduced. Accordingly, rigid framing systems which comprise members connected by the method of this invention are pre-actuated to function in the structural mode for which they are designed. Additionally, the structurally rigid framing systems of this invention produce increased efficiency in utilizing the flexural capabilities of the joined members.

The present invvention further permits a controlled degree of pre-stress and camber to be introduced to the connected flexural members prior to the application of service loads, for the purpose of regulating the subsequent stresses and deflections in the members under service load conditions. Furthermore, the degree of prestress and camber may be regulated and varied after, as well as during, assembly.

The invention also provides substantial latitude in adjustment for errors in fabrication and assembly, or both, which can be compensated without loss of capability for rigid frame action.

It should be emphasized that the present invention is of such universal application that it will readily permit the joining of flexural members of many diverse materials and shapes into rigid frames. This is done either by attaching the connecting elements directly to the members or by incorporating them in separate prefabricated assemblies which are then structurally attached to the members. Accordingly, the flexural members being connected may themselves be made of any material which is suitable to the particular application involved, such as steel, concrete, wood, plastic, laminates, composites, gypsum, paper-board, non-ferrous material, light-weight concrete and the like. The joining of members of such diverse materials has heretofore been very difficult according to the teachings of the prior art on rigid connections of the non-bonded type.

Yet another provision of the present invention is its capability of forming rigid framing systems by connecting a plurality of discrete rigid frames, or panels, in two- and three-dimensional configurations.

Furthermore, the framing systems of the present invention are completely reusable and may be dissassembled and reused without loss of form or efficiency.

Finally, the present invention permits the joining of flexural members at angles other than 90° without sacrifice of rigid frame action capability, thus permitting rigid frames of various geometric configurations.

Preferably, the rigid framing system of this invention comprises a plurality of flexural members which are joined by non-bonded connections which include at least one connecting tension means and at least one connecting compression means, spaced from each other along the joined faces of the flexural members and usually attached thereto, or fabricated thereon. These connecting means are arranged so as to be capable of bringing the joined flexural members into a bearing contact on their joined faces and form at least one fulcrum for relative rotation of the joined faces. Force-displacement means are usually associated with at least one of the connecting means, and positioned in the joint at a location other than at the fulcrum so as to produce and secure controlled relative rotation between the joined faces of the members about the fulcrum. The means for allowing relative rotation between the joined faces comprises any suitable geometric configuration of the connection that provides clearance for relative rotation and which does not restrict the required functioning of the force-displacement means. Resistance to the relative rotation between the joined faces of the flexural members is provided by the connections or anchorages on the other ends of the flexural members.

The method according to the present invention for effecting rigid frame action capability of framing systems generally comprises the steps of providing a plurality of flexural members and at least one tension and one compression connecting means spaced from each other along the faces thereof which are to be joined, connecting the flexural members so that the configuration of the connecting means provides clearance for relative rotation between the joint faces of the members and provides the fulcrum for the relative rotation, positioning at least one adjustable force-displacement means in the connection other than at the fulcrum and usually associated with the connecting means, assembling the flexural members into the desired frame configuration thereby providing mutual restraint to relative rotation of the joined faces, and actuating the force-displacement means so as to force relative rotation between the joined faces. Accordingly, the relative rotation and the flexural resistance of the members being joined, together with their imposed conditions of restraint, produces at least one force-couple at each connection and stores strain energy in both the connections and the flexural members so that they are forced into tight, rigid frames capable of effecting immediate moment transfer prior to application of vertical and horizontal loads.

BRIEF DESCRIPTION OF THE DRAWINGS

FIG. 12 also shows a side elevational view of a connection employing two tension connecting means straddling the fulcrum compression connecting means, and having a spring-load cell associated with one of the force-displacement devices to improve rigid frame action under reversing horizontal service loads.

DESCRIPTION OF THE PREFERRED EMBODIMENTS

Figure 1:
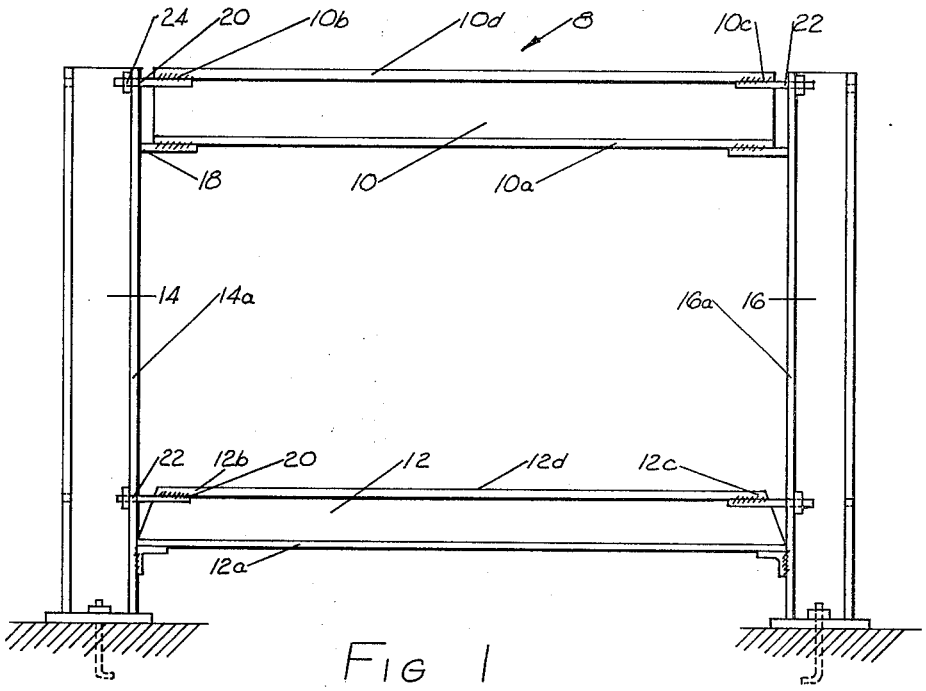
FIG. 1 is a side elevational view of a typical rigid frame of the present invention utilizing non-bonded connections.

As was previously discussed in the Summary of the Invention, a typical non-bonded rigid frame of the present invention is shown in FIG. 1. It will be seen that two vertical flexural or column members 14 and 16 support a pair of horizontal flexural beam members 10 and 12. The connecting means that form the fulcrums are the lower flange 12*a* of the beam 12, resulting from the bevel cut of the beam ends 12*b* and 12*c*, and the protruding plates 18, which are welded to the bottom flange 10*a* of each end 10*b* and 10*c* of the beam 10. The engagement of these protrusions at any suitable point on the inward faces 14*a* and 16*a* of the columns 14 and 16, respectively, produces the required common fulcrums and permits relative rotation of the joined faces. The upper flanges 10*d* and 12*d* of the beams 10 and 12 have at least one threaded rod 20 welded to each end of their undersides, the threaded portions of the rods 20 extending far enough beyond the ends of the beam 10 and 12 to pass through the holes 22 provided in the inward faces 14*a* and 16*a* of the column members 14 and 16, respectively, and permit full engagement with the nuts 24. Tightening of the nuts 24 brings the joined members into bearing contact at their common fulcrums. Further tightening of the nuts 24 causes the nuts 24 to act as force-displacement devices, producing a force-couple in each connection that causes relative rotation of the connected members about their common fulcrums. This rotation is resisted by the connections at the other end of each member, so that the members become locked into a rigid framing system. The amount of bending strain energy thereby stored in the system is controllable by the magnitude of force-displacement introduced. This stored strain energy forces the connected members together into a rigid framing system and creates and maintains tight connections capable of immediate transfer of moments upon the application of horizontal and vertical service loads. Accordingly, rigid framing systems which comprise members connected by the method of this invention are pre-actuated to function in the structural mode for which they are designed, and thereby the structural rigid framing systems of this invention produce increased efficiency in utilizing the flexural capabilities of the joined members.

Figure 2:
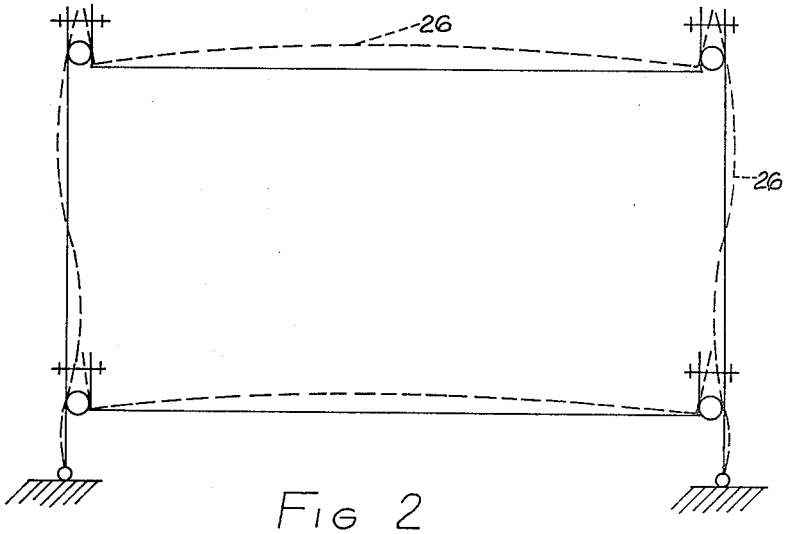
FIG. 2 is a schematic view of the frame of FIG. 1 showing the camber and deformations in the frame members prior to application of service loads.

FIG. 2 is a schematic view of the frame of FIG. 1 showing the camber and deformations 26 forcing the members together into a framing system and which are controllable by the magnitude of force-displacements introduced.

Figure 3:
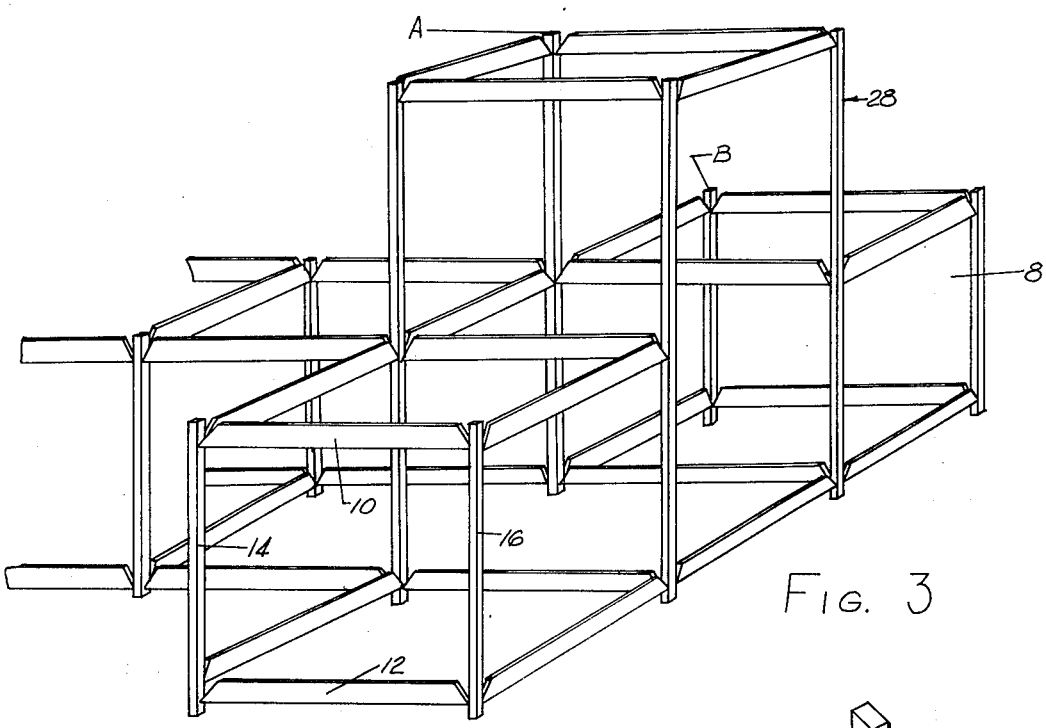
FIG. 3 is an isometric drawing of an exemplary three-dimensional rigid framing system of the present invention.

Turning now to FIG. 3, it will be seen that a plurality of typical frames 8 of FIG. 1 may be combined as desired to form two- and three-dimensional framing systems comprising numerous bays and stories, each frame having one member in common with each frame adjacent to it. It should be noted that the members of each frame 8 in the framing system are connected by the method of this invention and are pre-actuated so that all connections and frames of the framing system are capable of immediate transfer of moments upon the application of horizontal and vertical service loads.

Figure 4A:
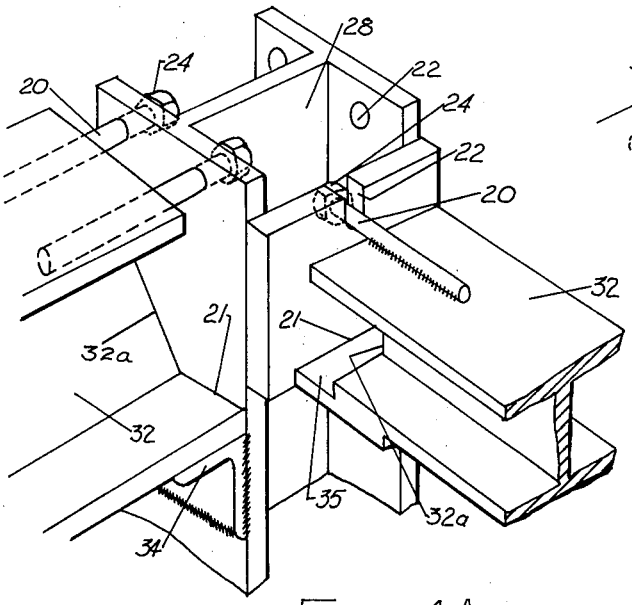
FIG. 4A is an enlarged perspective view of typical connections that could be used at the corner connections generally indicated at A or B of FIG. 3.
Figure 4B:
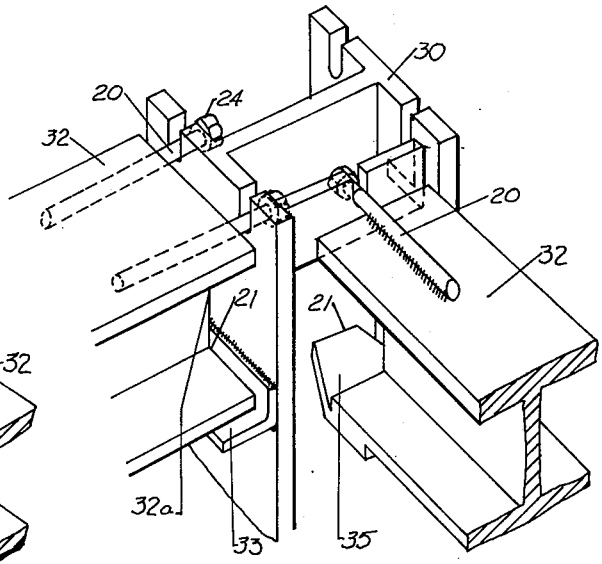
FIG. 4B is an enlarged perspective view of another embodiment of connections for use at the corner connections generally indicated at A and B of FIG. 3.

FIGS. 4A and 4B are enlarged perspective views of typical or exemplary connections such as at A and B of FIG. 3, respectively, between column members 28 and 30 and beam members joined thereto. In these embodiments, the connections are uniquely detailed to provide the physical means for isolating the tension and compression forces at predetermined locations, the distance between these two locations constituting the desired force-couple arm. The connecting tension means in both embodiments consists of either a bolt or a pair of bolts 20 welded to the top side or the underside of the top flange of the beam members 32. The connecting compression means consists of the bearing surfaces 21 obtained by the various configurations of the ends 32*a* of the beams 32. The tightening of the nuts 24 brings the column and beam members 28 and 32, and 30 and 32, into bearing contact at 21 forming common fulcrums for relative rotation between the joined faces. Further tightening of the nuts 24 causes them to act as force-displacement devices and produces controlled relative rotations of the joined faces. In rigid frames of the present invention, the restraint imposed by the connections or anchorages at the ends opposite to where the connections are made, together with the relative rotation, produces the required force-couple at the joint that stores strain energy in the system, and which forces the members into a rigid framing system.

At this point it should be noted that seat angle 34 has been shown on the column members 28 and another arrangement is shown by angle 33 on column 30 for added shear resistance. Although analyses by way of calculations and actual load tests show that the combination of friction at the compression connecting means and a suitable cross section of the tension connecting means together provide adequate shear resistance for working service loads, seat angles 33 and 34 or other suitable means may be provided for additional shear capacity. Such shear connections may be fabricated on either of the two flexural members of a joined pair, but must not restrain the desired relative rotation of the joined faces during assembly. The positive engagement of the unengaged portions of the shear connectors is effected after final adjustment of the frame connections.

Figure 5:
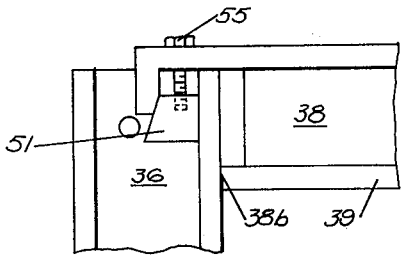
FIG. 5 is a side elevational view of a typical non-bonded connection wherein the force-displacement means is a wedge associated with the tension connecting means.
Figure 6:
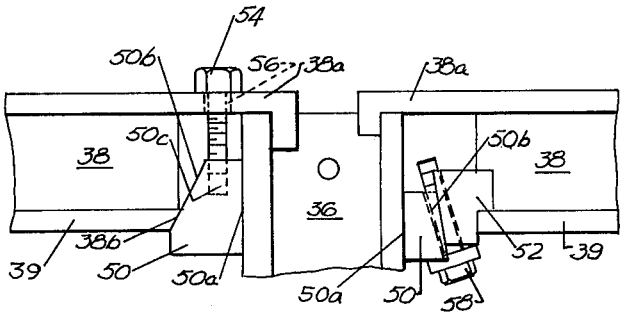
FIG. 6 is a side elevational view of typical connections, wherein the force displacement means is a wedge associated with the compression connecting means.

It should be emphasized that in some figures of the drawings which show details of the embodiments of the non-bonded connections used in the frames of the present invention, the means which provide resistance to the relative rotation between the joined faces of the flexural members are not shown, but are assumed to be provided. Furthermore, it will be understood that beam members may be connected to any side or sides of any column member even though the connecting means associates with the column member for such beam members are not shown in the figures.

it will, of course, be obvious to one skilled in the art that the rigid frame of this invention may be achieved in a variety of ways, and that frame members made of various materials may be joined. FIGS. 5 and 6 are exemplary connections of the frame systems of the present invention wherein the connecting tension means serve as fulcrums and are non-adjustable, as they are of a predetermined length, and the adjustment is made in the force-displacement device associated with the connecting compression means, such as bolts, wedges, and the like.

In FIG. 6 the connecting tension means for each joint is non-adjustable, thus serving as the common fulcrum, and the adjustment is made by means of connecting compression wedges. As can be seen, a column member 36 is joined to the beam members 38. The connecting tension means 38*a* of each beam member 38 is fixed in length. The adjustable force-displacement device comprises generally an adjustable wedge 50, one surface 50*a* of which is parallel to and contiguous with the joined face of the column member 36 and the other surface 50*b* of which is sloping and bears against either the sloping surface 38*b* of the beam flange 39 or the sloping block 52. The wedge 50 may be adjusted by any suitable force-displacement means. For example a bolt 54 may extend through an aperture 56 in the fixed connecting tension means 38*a* and extend into a threaded bore 50*c* in the top of the wedge 50. After the connection is assembled, the bolt may be turned to move or displace the wedge upwardly until the required relative rotation between the joined faces of the beam member 38 and the column member 36 have been achieved. If a sloping block 52 is utilized, the wedge 50 may be adjusted by means of the force-displacement threaded bolt 58 positioned between, and engaging corresponding threads in both the wedge 50 and the sloping block 52. Depending upon how the wedge 50 is positioned, movement of the force-displacement bolt 58 will cause the wedge 50 to move upwardly or downwardly.

It will, of course, be understood that connecting compression means 38*b* of the beam member 38 may likwise be fixed in length, i.e., non-adjustable, and that the adjustment may be made by means of a connecting tension wedge 51 and force-displacement bolt 55, as shown in FIG. 5.

Figure 7:
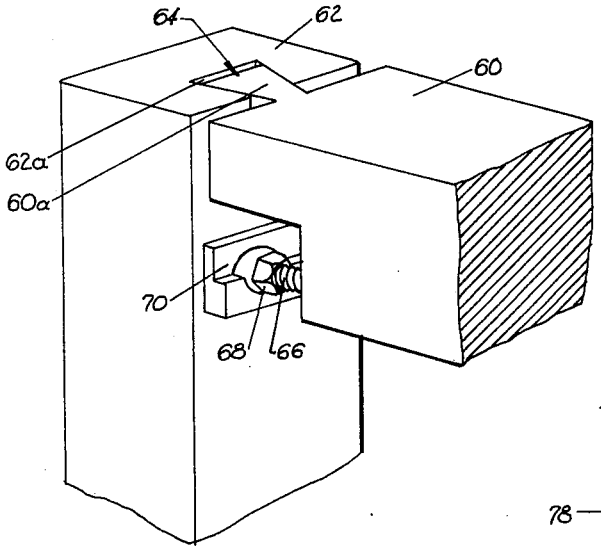
FIG. 7 is a perspective view of a non-bonded connection for joining flexural members of solid cross-section, wherein the tension connecting means is a dovetail and the force-displacement means is a threaded rod associated with the compression connecting means.

FIG. 7 is a perspective view of a connection between the joined faces of a beam member 60 and a column member 62 in a frame of the present invention. The frame members are first joined by engaging the connecting tension means 64, and then by turning the force-displacement nut 68 on the threaded rod 66 in the beam member 60, the connection is rendered rigid. As can be seen, the column member 62 is provided with a solt 62*a* at its joined face into which the dovetail or key 60*a* of the beam member 60 is inserted. A bearing plate 70 is mounted on the column member 62 and receives the force-displacement nut 68.

It is furthermore within the scope of this invention that force-displacement means or devices may be associated with both the connecting tension and the connecting compression means in the same connection.

It will also be clear to one skilled in the art that many variations are possible in the geometry of the joined faces of the joined members shown in the basic embodiment of FIG. 1. For example, the configuration allowing relative rotation of the joined faces may be provided by the addition, or inclusion of any desired protrusion from the joined face of either member, such as the protrusions 35 on the beam members 32 in FIGS. 4A and 4B. Such protrusions may also be built on the column member, as at 33 in FIG. 4B. In any configuration, the butting portion 21 of a connecting compression means may be flat-faced, rounded, knife-edged or even pointed. or even pointed.

The present invention makes it possible to connect members made of any material suitable to the particular application involved, such as steel, concrete, wood, plastic, laminates, composites, gypsum, paperboards, non-ferrous metals, light-weight concretes, and the like. Additionally, the present invention enables a great variety of shapes, some heretofore unjoinable, to be used effectively as members in framing systems. Such a variety of conventional structural shapes, and I and wide-flange, channels, angles, tees, U-sections, and square and circular tubing and open-web joists may be used. Conventional or uncoventional shapes may be used by attaching to the ends of the members to be joined a suitable prefabricated connector. Accordingly, members having geometric cross-sections such as triangles, squares, rectangles and other polygons, circles, ovals, and the like, may be used.

It should be pointed out that the members being joined may be made to form a variety of rigid frame geometric configurations. In addition to the more common rectangular and triangular frames, other polygons, hyperbolic paraboloids and even curved configurations may be assembled.

Figure 8:
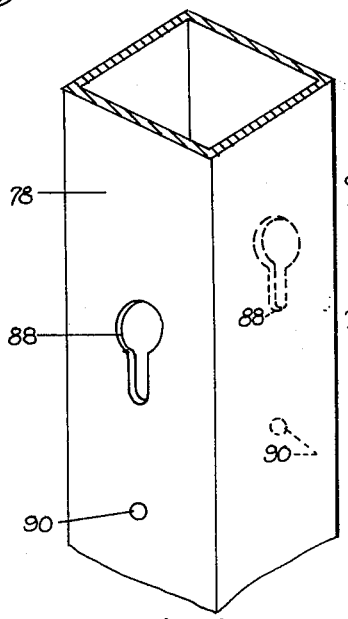
FIG. 8 is a perspective view of a connection between a compounded wooden beam and a length of tubular steel column, wherein the force-displacement device can be actuated on either end of the tension connecting means.
Figure 8:
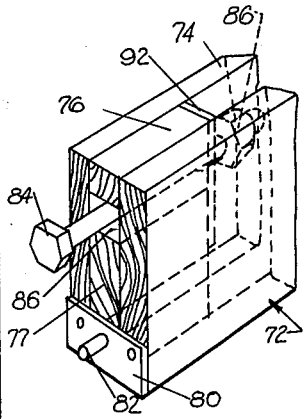

FIGS. 8, 9, 13 and 13A generally illustrate a variety of connections in the frames of the present invention which are used to join members made of a variety of materials. In FIG. 8 a composite wooden beam member 72, which comprises two standard wood planks 74 fastened or bonded together through the wooden spacer blocks 76 and 77, is joined to a steel column member 78. A steel plate 80 is secured, as by nails or wood screws, to the end of the beam member 72 and a guide pin 82 is welded thereon to provide extra shear capacity. The connecting tension bolt 84 receives an adjustable force-displacement device, which comprises the nut 86 threadedly received on the end of the tension bolt 84. As can be seen, the bolt 84 extends through an aperture 86*a* between the end spacer blocks 76 and 77 and protrudes from the end of the wooden beam member 72 so that it may be received within the keyhole 88 on the face of the steel column 78. An aperture 90 is also provided in the face of the steel column 78 to receive the guide pin 82. A steel plate 92 is preferably provided on the inside of the end spacer blocks 76 and 77 to act as a bearing against which the nut 86 may rest. The plate 80 engages the face of the column 78 and serves as the fulcrum and connecting compression means when the frame elements are connected.

Figure 9:
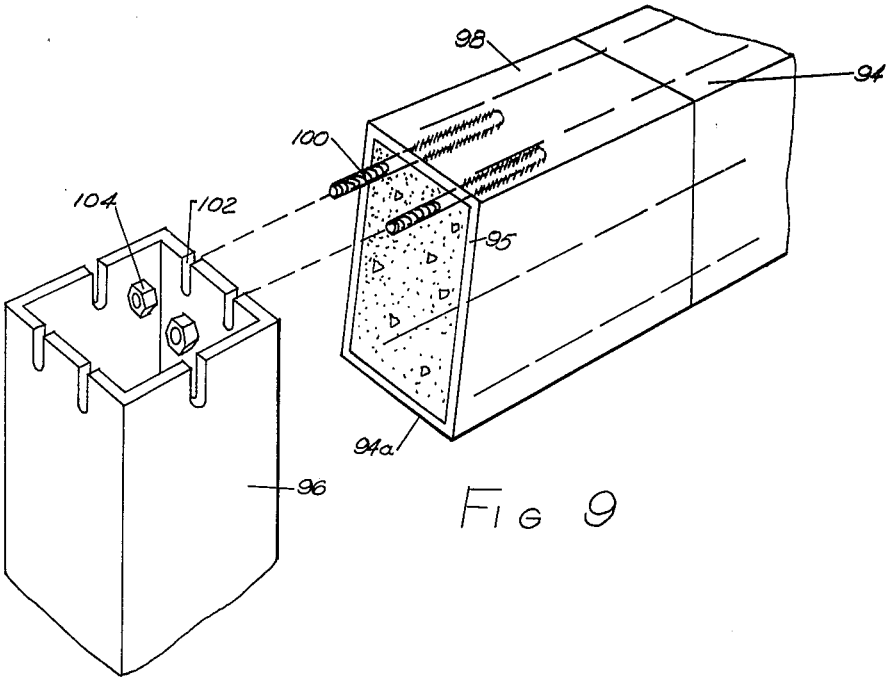
FIG. 9 is a perspective view of an exemplary connection, wherein a concrete beam member is integrally cast with a tubular steel section to which are attached the tension connecting means for joining to a tubular steel column member.

FIG. 9 discloses a further embodiment of the connection in the frame of the present invention used to join a concrete beam member 94 to a steel tube column member 96. The concrete beam member 94 is provided with a steel tube end member 98 provided with a bevel cut 95. Connecting tension bolts 100 are prewelded to an inside face of the end member 98. The steel tube column member 96 is provided with the slots or holes 102 which receive the connecting tension bolts 100. The adjustable force-displacement devices for introducing relative rotation between the joined faces of the concrete beam member 94 and the steel tube column 96 comprise the nuts 104 which are threaded on the ends of the connecting tension bolts 100. The leading edge 94*a* of the bevel cut 95 acts as the connecting compression means.

Figure 13:
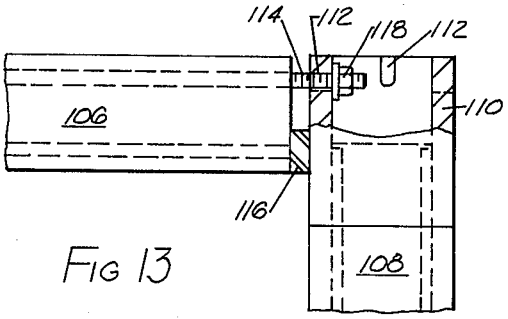
FIG. 13 is a side elevational view, partially in section, of an exemplary non-bonded connection of a frame of the present invention which is used to join two precast reinforced concrete members, where the column member is provided with a steel tube cap.
Figure 13A:
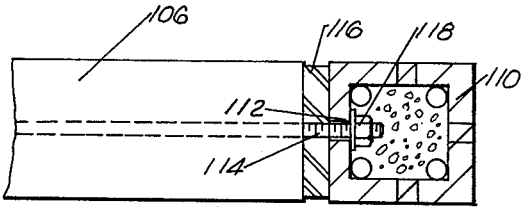
FIG. 13A is a plan view of the connection of FIG. 13.

FIGS. 13 and 13A show the side elevational view and plan view, respectively, of the use of a connection in the frame of the present invention to join a pre-cast reinforced concrete beam 106 to a pre-cast reinforced concrete column 108. The reinforced concrete column 108 is provided with a steel tube cap member 110 having therein slots or holes 112 which receive the connecting tension bolt 114 protruding from the joined face of the reinforced concrete beam 106. This bolt 114 may be formed by threading the end of one of the reinforcing rods of the beam 106. A connecting compression means, such as the metal pad 116, is attached to either the joined face of the concrete beam 106 or the face of the steel tube cap member 110. The adjustable force-displacement device comprises a nut 118 threadedly received on the end of the connecting tension bolt 114. The steel tube cap member 110 may be integrated with the concrete column 108 at the time of fabrication or may be attached subsequently, as desired.

Figure 10:
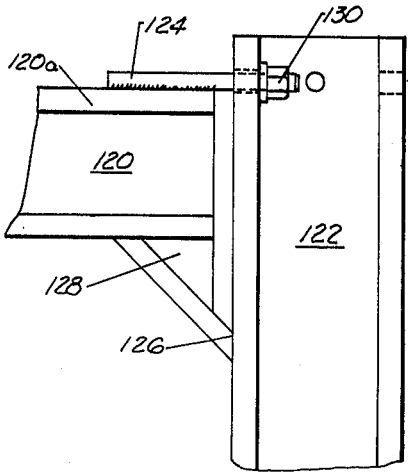
FIG. 10 is a side elevational view of a connection in a frame of the present invention, wherein the efficiency of the connecting means is enhanced by increasing their spacing from each other along the joined faces, thus increasing the force-couple arm.

The rigidity of a frame in a framing system of the present invention may be enhanced by increasing the distance or force-couple arm between the connecting tension and compression means in a connection. FIG. 10 discloses an exemplary connection in the frame of the present invention which is designed to achieve this result. There a beam member 120 is joined to a column member 122. The connecting tension means comprises at least one threaded bolt 124 welded to the top of the upper flange 120*a* of the beam member 120, and the distance between the bolt 124 and the connecting compression means 126 is increased by a stiffened plate 128 welded to the underside of the beam member 120. The relative rotation is forced between the joined faces of the flexural members before the application of loading by means of the force-displacement adjustable nuts 130 associated with the bolts 124.

Figure 11:
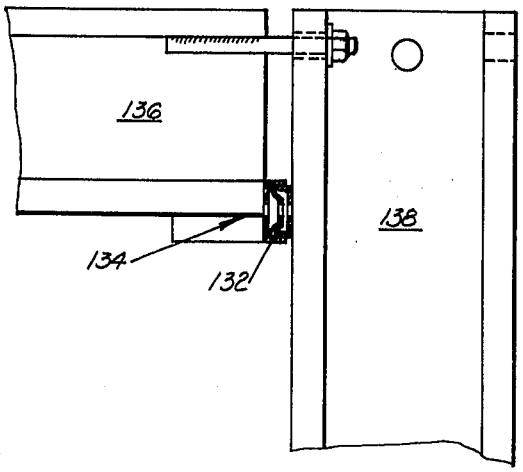
FIGS. 11 and 12 are side elevational views of exemplary connections in a frame of the present invention, wherein a spring-load cell is incorporated with either the connecting tension or connecting compression means.
Figure 12:
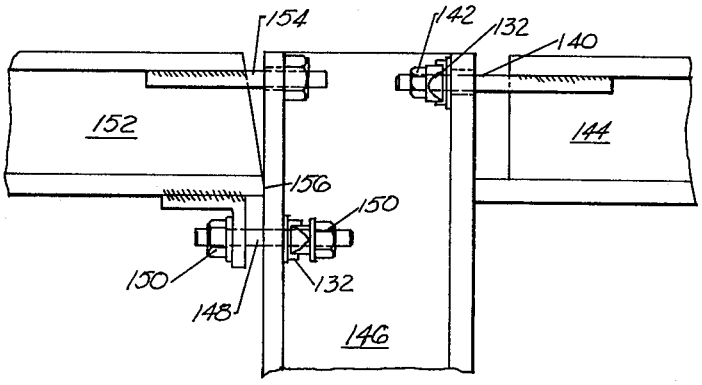

FIGS. 11 and 12 show how a connection in a frame of the present invention makes possible the attainment of a more ideal distribution of bending moments throughout the elements of a rigid frame system by incorporating suitable spring-load cells 132 in either the connecting tension or the connecting compression means of the connections, or both.

In FIG. 11, the spring-load cells 132 are incorporated with the connecting compression means 134 between the beam member 136 and the column member 138. In FIG. 12, the spring-load cells 132 have been incorporated with the connecting tension bolts 140 and their respective adjustable force-displacement devices, such as the nuts 142, for introducing relative rotation between the joined faces of the beam member 144 and the column member 146, and with the connecting tension bolts 148 and their respective adjustable force-displacement devices, such as the nuts 150. When the cells 132 are placed at either, or both, the connecting tension and connecting compression means between a beam member and a column member, they allow specific rates of rotation of the joined faces with load. The free choice of the load-deformation characteristics of the spring-load cells 132 permit re-distribution of moments in framed beam members and column members of the present invention, resulting in considerable reduction in maximum bending moments, permitting use of lighter flexural members.

FIG. 12 is also illustrative of a connection between a beam member 152 and a column member 146 and a frame system of the present invention which employs two connecting tension means, such as the bolts 148 and 154, straddling the fulcrum connecting compression means 156 to improve rigid frame action under reversing horizontal service loads, such as, for example, wind loads. In practice, the lower connecting tension means 148 is secured after all of the top connecting tension means 154 are set.

Figure 14:
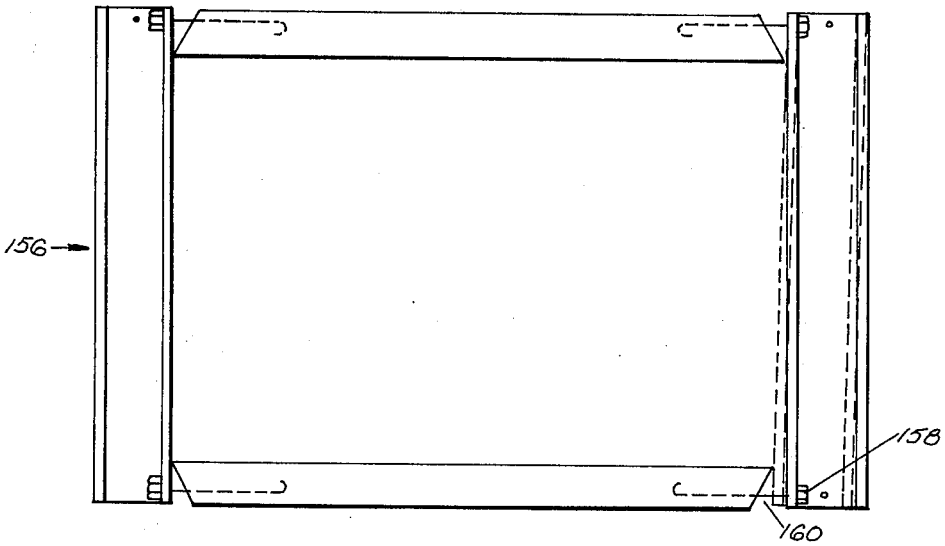
FIG. 14 is a side elevational view of a frame of the present invention, wherein the connecting means and adjoining members, by accurate dimensioning of the assembly, result in a frame system which is made rigid through the actuation of only one force-displacement means.

By accurate design and fabrication of the flexural members and connections of a single frame according to this invention, rigid frame action can be effected by providing and actuating force-displacement means in only one of the frame connections. The degree of adjustability of the frame, and its capability for rigid frame action, increases as force-displacement means are provided in additional connections thereof. Such an embodiment is disclosed in FIG. 14, wherein a frame 156 is made rigid with only one adjustment, such as the adjustment on the force-displacement device 158 on the connecting element 160. This simultaneously induces the required locking force-couples into all four joints of the frame 156.

Figure 15:
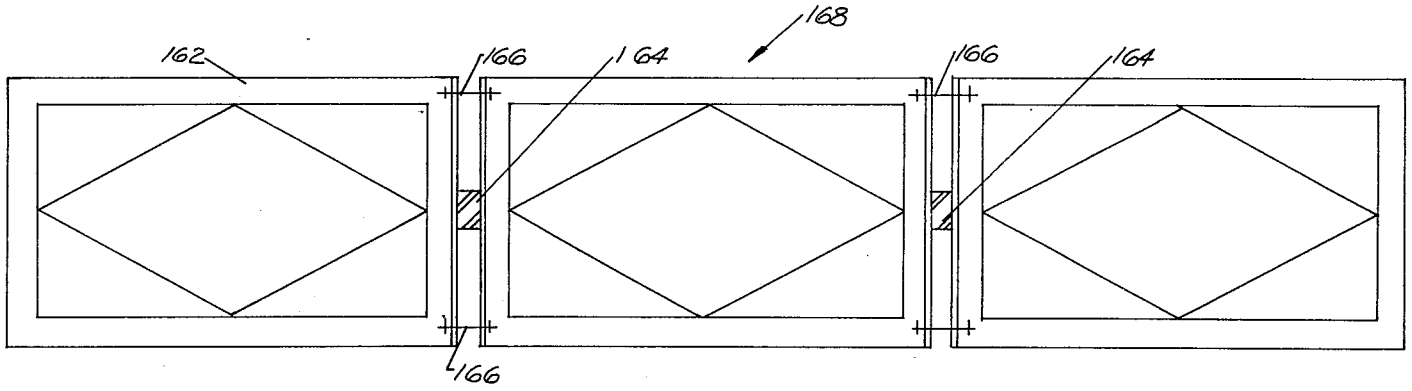
FIG. 15 is a side elevational view of a series of discrete rigid frames, each frame joined to its adjacent frame by one compression connecting means straddled by two connecting tension means, thereby forming an extended rigid framing system.

FIG. 15 discloses still a further embodiment of the present invention, wherein a series of discrete rigid frames 162, such as welded frames having internal bracing, or panels, are each joined to adjacent frames by one connecting compression means 164 straddled by connecting tension means 166, to form an extended rigid framing system 168.

Figure 15A:
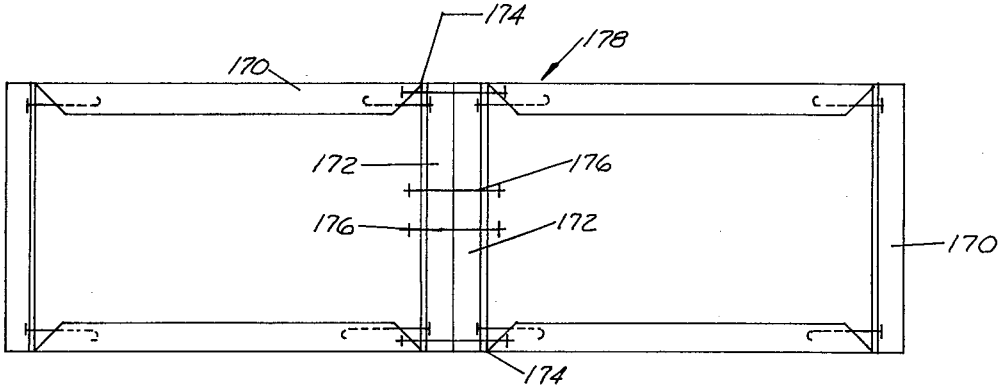
FIG. 15A shows an embodiment of the framing system of FIG. 15, wherein two compression connecting means straddle at least one tension connecting means, the tension being derived from the restrained inward camber of the joined columns.

A further embodiment of the extended rigid framing system is shown in FIG. 15A, wherein two discrete pre-assembled frames 170 of the present invention are joined together by two connecting compression means 174 which straddle connecting tension means 176 to form an extended rigid framing system 178, the rigid connection deriving from the restrained inward camber of the joined members 172.

Figure 16:
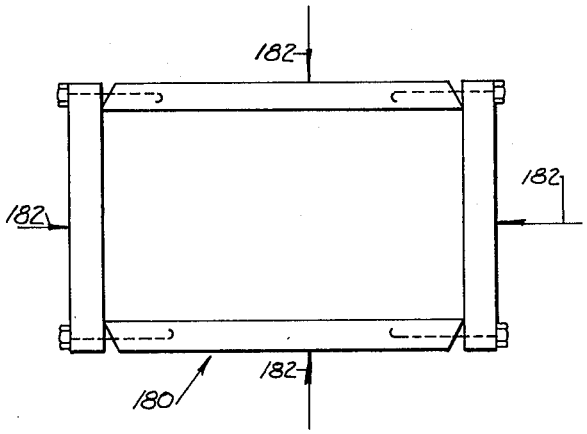
FIGS. 16 and 16A are side elevational views of exemplary frames of the present invention and indicate how the arrangement of the connecting means can make the rigid frames resist either inward or outward service loads.
Figure 16A:
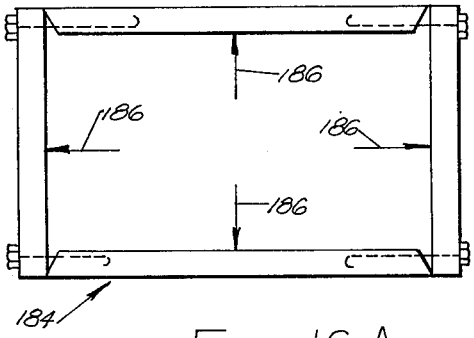

While it is more common to consider resistance of a frame to inward loads, it will be clear to one skilled in the art that the connecting means in a frame of this invention may be positioned so as to create a rigid frame which is more resistant to loads applied outwardly than inwardly. The two rigid frames in FIGS. 16 and 16A are illustrative of this principle. For example, the connecting means in the frame 180 are positioned so that the frame 180 will resist inward loading, indicated by the arrows 182. Conversely, the connection means in the frame 184 are positioned so that the frame 184 will resist outward loading, indicated by the arrows 186.

Numerous modifications of the present invention will be obvious to one skilled in the art. For example, the connecting tension means of the connections may incorporate means, such as washers, to distribute the stresses in the joined members over a larger surface for the prevention of distortions. Additionally, shapes, such as angles and the like, may be used as connecting compression means for the same purpose.

It should be emphasized that the rigidity and moment transfer capacity of connections in the frames of the present invention may be adjusted by the proper choice of the free length and cross-sectional area of the connecting elements. This permits the design of frames using semi-rigid connections that result in more ideal distribution of beam moments and consequent reduction in member weights. Furthermore, it will be clear to one skilled in the art that by suitable design and fabrication of the joined faces of the flexural members and the connecting elements thereof, framing systems may be assembled having angles other than 90° between joined flexural members.

Figure 17:
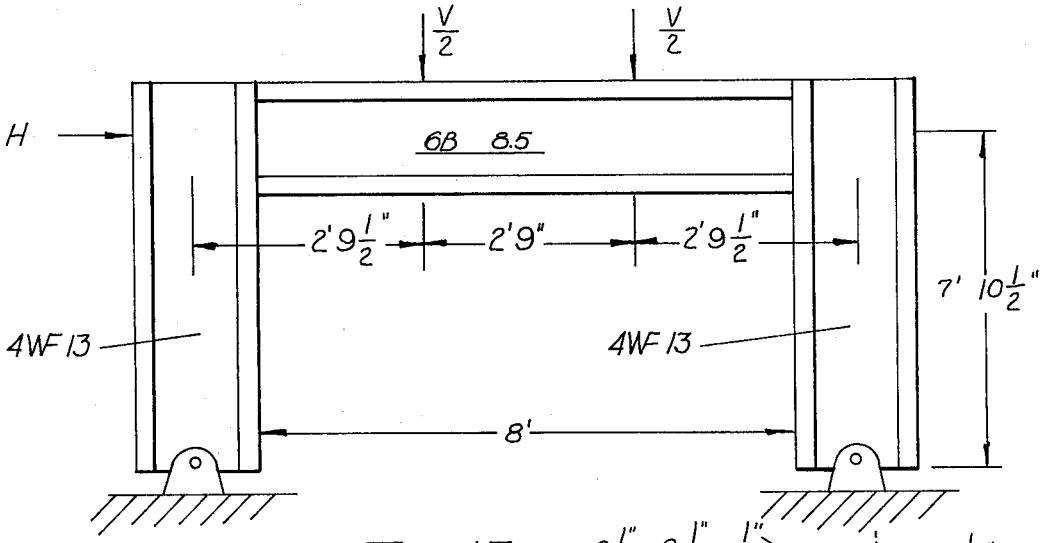
FIG. 17 is a schematic representation of frames on which tests were performed in order to ascertain relative load-carrying characteristics and rigidity.
Figure 17A:
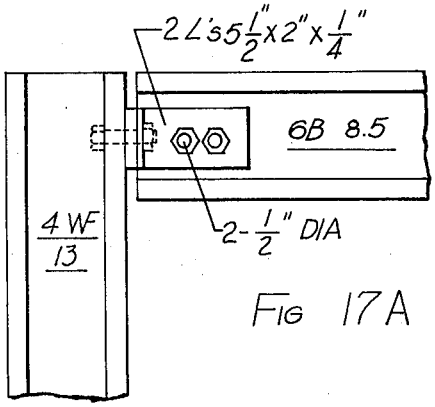
FIGS. 17A through 17D are enlarged detailed views of the connections of the tested frames according to FIG. 17.
Figure 17B:
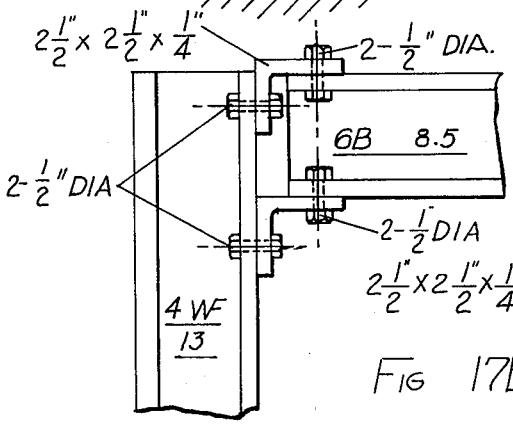
Figure 17C:
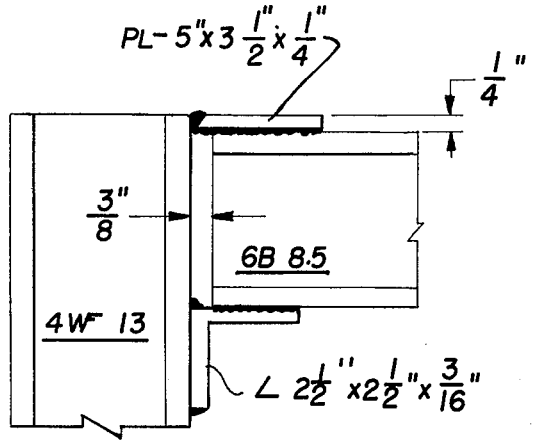
Figure 17D:
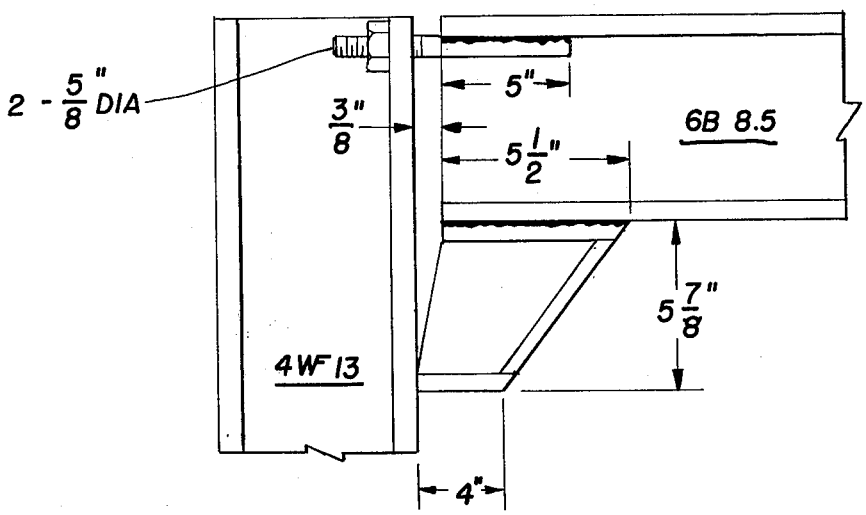

Tests have been performed on various frames in order to compare the rigidity and load carrying characteristics thereof. FIG. 17 is a schematic representation of frames A, B, C and D on which tests were performed, and detailed in FIGS. 17A, 17B, 17C and 17D, respectively. The series of tests are to define the load-deflection characteristics of an exemplary steel frame of this invention as compared to the behavior of frames with three different types of standard steel connections. Each frame was pin-connected at the base, and included steel members of identical section and length. The rigidity of the exemplary frame D was designed to equal the rigidity of the welded frame C. The vertical and horizontal loads applied conformed with normal loading conditions. The vertical design load on the beam corresponded to the sum of a uniform deadload of 266 pounds per foot of beam and a uniform live load of 300 pounds per foot. The horizontal design load on the frame corresponded to 120 pounds per foot wind load on the column. The test results are in the form of load-deflection curves, as shown in FIGS. 18 through 20.

Figure 18:
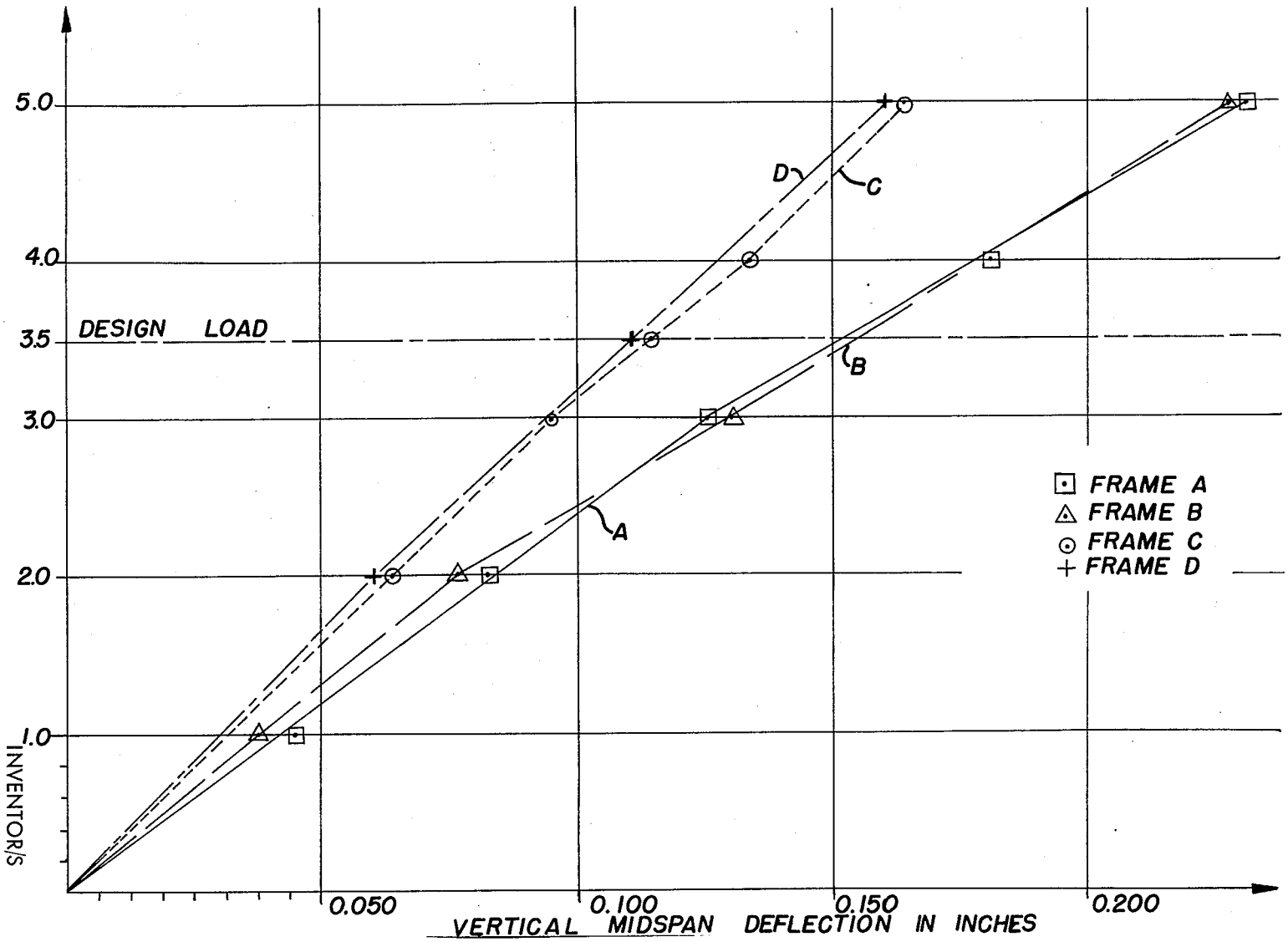
FIGS. 18 through 20 are a graphical summary of the results of a testing program on the frames of FIG. 17.

FIG. 18 presents vertical gross deflections at the midspan of the beam as a function of the vertical load only.

Figure 19:
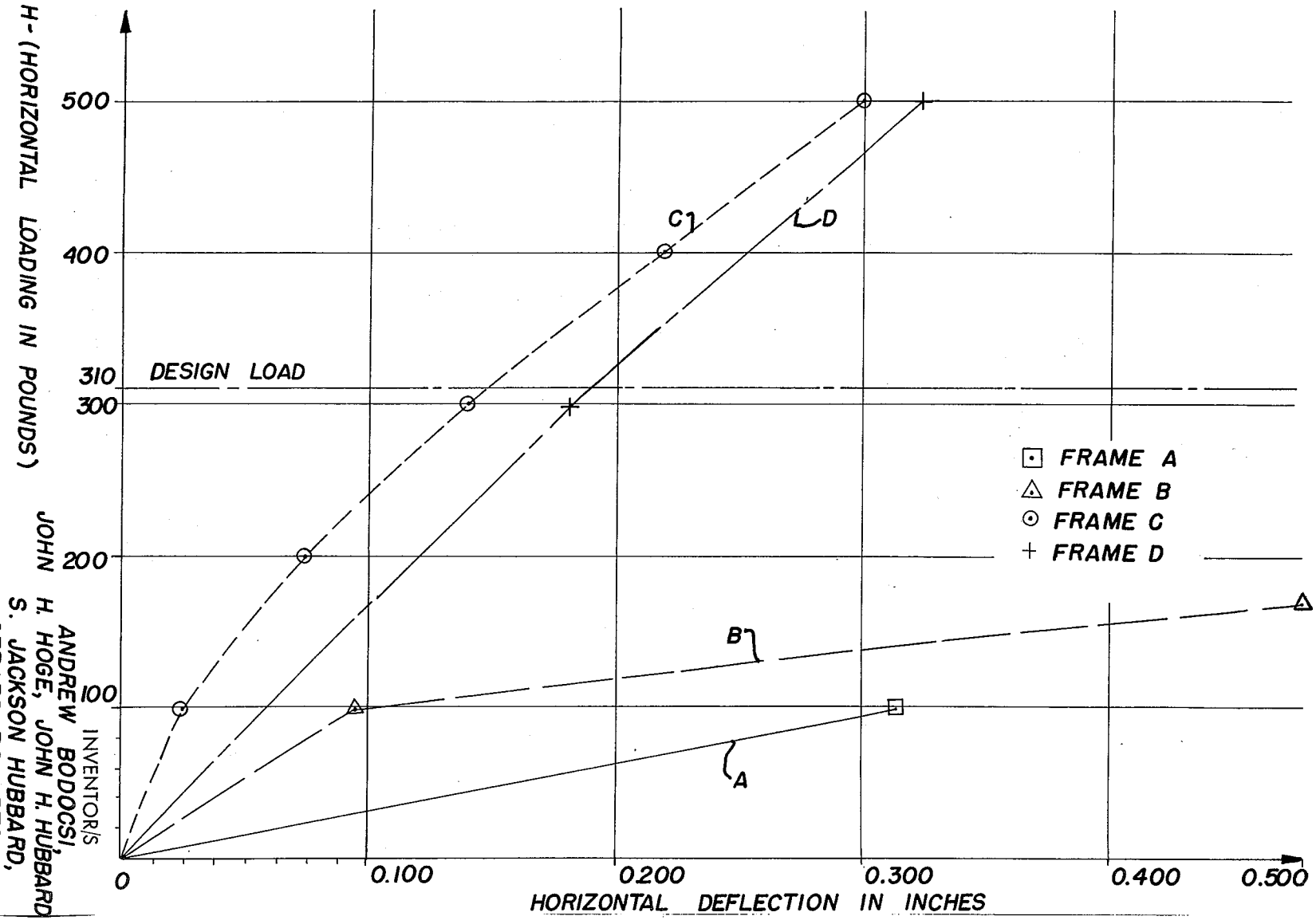

FIG. 19 presents horizontal deflections along the axis of the beam as a function of horizontal load only.

Figure 20:
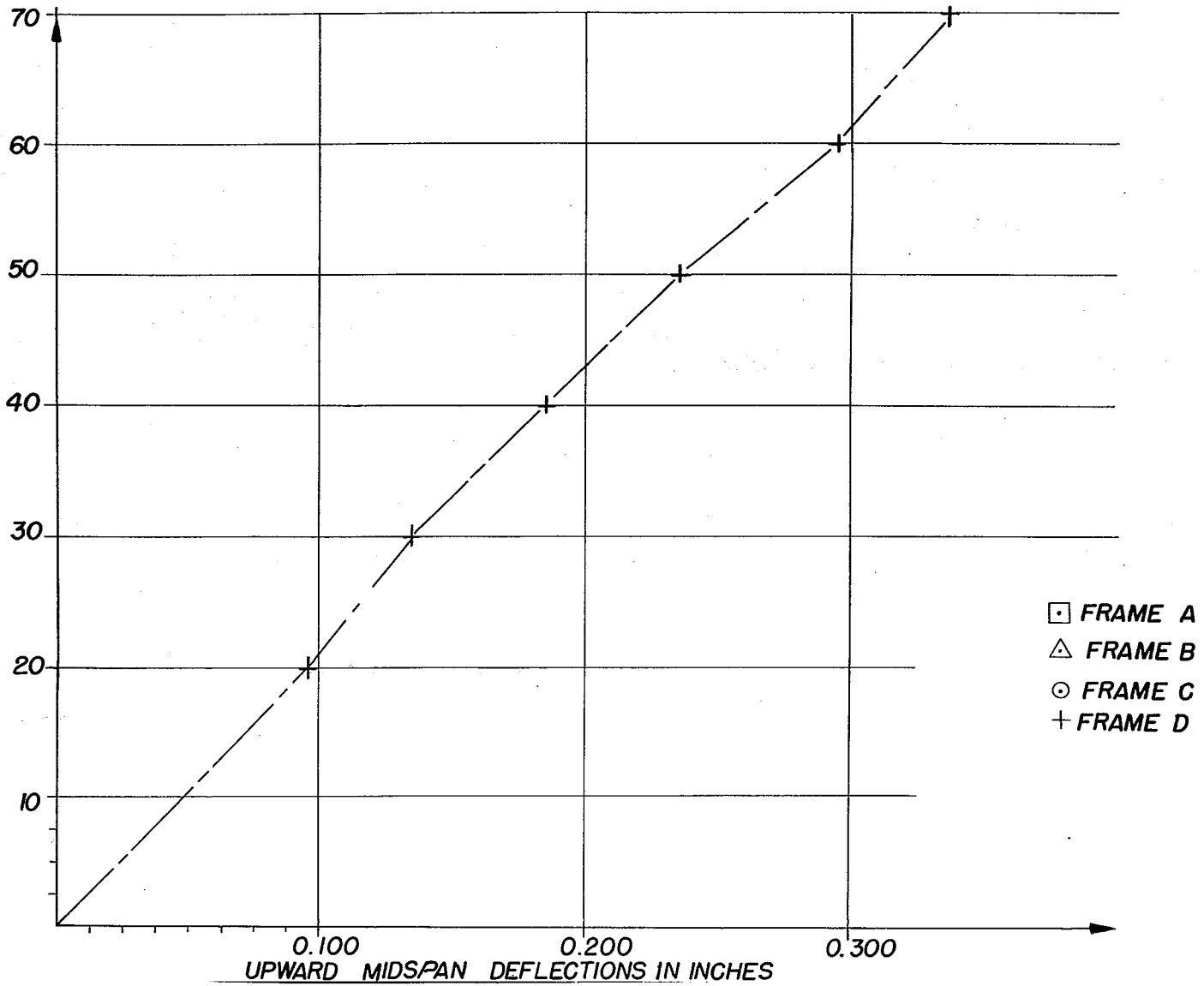

FIG. 20 presents upward deflections measured at midspan of the beam caused by varying torque applied to the connecting tension bolts (frame D).

The frames analyzed include frame A using standard bolted web connections, frame B with bolted moment connections, frame C using an all-welded moment connection, and frame D of the present invention.

Vertical load vs. gross deflection curves for the four representative frames are shown in FIG. 18. It is evident that frame D responds as rigidly as frame C.

The horizontal load vs. deflection curves for the four frames are shown in FIG. 19. It can be seen that frame D is nearly as rigid as the all-welded frame C.

FIG. 20 illustrates the relationship between torque applied to the connecting tension bolts and the mid-span upward deflection or camber of the beam as induced by the torque. Because this camber is produced during assembly of the frame, any subsequent loading must overcome the camber before net deflections will occur. Thus the frame of this invention is shown to provide a means of controlling deflections in the beam thereof due to the applied service loading.

A number of conclusions may be drawn from the data shown in FIGS. 18 through 20. First, the deflections under vertical loading of a rigid frame of this invention are comparable to those in welded frames. Further, a frame of this invention approaches a welded frame in its resistance to horizontal or lateral loads. Also, the camber and net deflections of frame members can be favorably controlled by the rigid framing system of this invention.

The embodiments of the invention in which an exclusive property or privilege is claimed are defined as follows:

1. A non-bonded, prestressed, rigid frame structure providing post-tension and resulting camber in all flexural members comprising beam members and at least three spaced column members with each said beam member being joined at each of its end faces to a side face of one of said column members by post-tensioned, moment-transferring connections, said beam members each having at least one adjustable tension connecting element and at leastt one compression connecting element on the end faces thereof, said column members each having corresponding tension and compression connecting elements on the side faces thereof for mating with said connecting elements on the end faces of said beam members, said mating connecting compression elements comprising the distending edge of a bias cut end face of said beam members engaging a compression bearing surface on a side face of said column members in unattached abutment to cause a spacing apart of said joined end and side faces at the locations of said mating tension connecting elements and serving as compression fulcrums for unrestricted relative rotation between saidd joined end and side faces, and said adjustable mating tension connecting elements comprise at least one threaded rod attached to the upper portion of the end faces of said beam members and extending therefrom through corresponding apertures in the spaced apart side faces of said column members, and secured thereto by nuts, and resistance to said relative rotation comprising only the deadweight of said members and their connections at the other ends of said beam and column members, whereby the tightening of said nuts produces and secures controlled relative rotation about said compression fulcrums between respective pairs of said joined members and tensions and cambers all of said joined beam and column members of said frame structure and renders said connections therebetween capable of immediate moment transfer and said frame structure capable of supporting vertical and horizontal service loads in rigid frame action.

2. A non-bonded, prestressed, rigid frame structure providing post-tension and resulting camber in all flexural members comprising beam members and at least three spaced column members with each said beam member being joined at each of its end faces to a side face of one of said column members by post-tensioned, moment transferring connections, said beam members each having at least one tension connecting element and at least one adjustable compression connecting element on the end faces thereof, said column members each having corresponding tension and compression connecting elements on the side faces thereof for mating with said connecting elements on the end faces of said beam members, said mating connecting compression elements comprising at least one threaded rod secured to the lower side of said beam member at the lower edge of its end face and an associated threaded nut, one end of which extends from said rod to engage said compression bearing surfaces on the side faces of said column members in unattached abutment, said mating tension connecting elements comprising at least one tension member on end of which is fixedly secured to the upper portion of the end face of each said beam member and the other end of which is fixedly secured to the mating side face of said column members and serving as a tension fulcrum for unrestricted relative rotation between said joined end and side faces of said beam and column members, and resistance to said relative rotation comprising only the deadweight of said members and their connections at the other ends of said beam and column members, whereby the turning of said threaded nuts forces apart said joined end and side faces of said beam and column members at said compression connections to produce and secure controlled relative rotation about said tension fulcrums and post-tension and camber all of said joined beam and column members of said frame structure and render said connections therebetween capable of immediate moment transfer and said frame structure capable of supporting vertical and horizontal service loads in rigid frame action.

3. A non-bonded, prestressed, rigid frame structure providing post-tensioning and resulting camber in all flexural members comprising beam members and at least three spaced column members with each said beam member being joined at each of its end faces to a side face of one of said column members by post-tensioned, moment transferring connections, said beam members each having at least one tension connection element and at least one adjustable compression connecting element associated with the end faces thereof, said column members each having corresponding tension and compression connecting elements on the side faces thereof for mating with said connecting elements on the end faces of said beam members, said mating connecting compression elements comprising a wedge the sloping surface of which is contiguous with the compression portion on the end face of said beam members and the other surface engages the compression bearing surface on the side faces of said column members in unattached abutment, and an associated threaded bolt one end of which extends through said tension connecting element and into a threaded hole in said wedge, and said mating tension connecting elements comprising at least one tension member one end of which is fixedly secured to the upper portion of the end face of said beam members and the other end of which is fixedly secured to the mating side face of said column members and serving as a tension fulcrum for unrestricted relative rotation between said joined end and side faces of said beam and column members, and resistance to said relative rotation comprising only the deadweight of said members and their connections at the other ends of said beam and column members, whereby the turning of said threaded bolt causes said wedge to force apart said joined end and side faces of said beam and column members at the location of said compression connection to produce and secure controlled relative rotation about said tension fulcrums and tension and camber all of said joined beam and column members of said frame structure and render said connections therebetween capable of immediate moment transfer and said frame structure capable of supporting vertical and horizontal service loads in rigid frame action.

4. A non-bonded, prestressed, rigid frame structure providing post-tensioning and resulting camber in all flexural members comprising beam members and at least three spaced column members with each said beam member being joined at each of its end faces to a side face of one of said column members by post-tensioned, moment-transferring connections, said beam members each having at least one tension connecting element and at least one adjustable compression connecting element associated with the end faces thereof, said column members each having corresponding tension and compression connecting elements on the side faces thereof for mating with said connecting elements on the end faces of said beam members, said mating connecting compression elements comprising a pair of cooperating adjustable wedges having mating surfaces, the non-mating surface of one of said wedges being contiguous with the compression location on the end face of said beam members and the non-mating surface of said other wedge bearing against and engaging the compresssion bearing surface on the side faces of said column members in unattached abutment, and a threaded bolt positioned between said mating surfaces and engaging mating threads in both of said wedges, and said mating tension connecting elements comprising at least one tension member one end of which is fixedly secured to the upper portion of the end face of said beam members and the other end of which is fixedly secured to the mating side face of said column members and serving as a tension fulcrum for unrestricted relative rotation between said joined end and side faces of said beam and column members, and resistance to said relative rotation comprising only the deadweight of said members and their connections at the other ends of said beam and column members, whereby the turning of said threaded bolt causes said wedges to force apart said joined end and side faces of said beam and column members at the location of the compression element to produce and secure controlled rotation about said tension fulcrums and tensions and cambers all of said joined beam and column members of said frame structure and renders said connections therebetween capable of immediate moment transfer and said frame structure capable of supporting vertical and horizontal service loads in rigid frame action.

5. A non-bonded, prestressed, rigid frame structure providing post tension and resulting camber in all flexural members comprising beam members and at least three spaced column members with each said beam member being joined at each of its end faces to a side face of one of said column members by post-tensioned, momement transferring connections, moment beam members each having at least one adjustable tension connecting element and at least one compression connecting element on the end faces thereof, said column members each having corresponding tension and compression connecting elements on the side faces thereof for mating with said connecting elements on the end faces of said beam members, said mating connecting compression elements comprising a butt plate secured to the lower portion of each end face of said beam members extending therefrom and engaging a compression bearing surface on a side face of one of said column members in unattached abutment to cause a spacing apart of said joined end and said faces at the locations of said mating tension connecting elements and serving as compression fulcrums for unrestricted relative rotation between said joined end and side faces, and said adjustable mating tension connecting elements comprising at least one threaded rod attached to the upper portion of each end face of said beam members and extending therefrom through corresponding apertures in the spaced apart side faces of said column members, and secured thereto by nuts, and resistance to said relative rotation comprising only the deadweight of said members and their connections at the other ends of said beam and column members, whereby the tightening of said nuts produces and secures controlled relative rotation about said compression fulcrums between respective pairs of said joined members and post-tensions and cambers all of said joined beam and column members of said frame structure and renders said connections therebetween capable of immediate moment transfer and said frame structure capable of supporting vertical and horizontal service loads in rigid frame action.

6. The frame structure according to claim 5, wherein said butt plates are extended angularly downward to increase the distance between said threaded rod and said compression bearing surface on the side face of said column member at each said connection.

7. A non-bonded, prestressed, rigid frame structure providing post-tensioned and resulting camber in all flexural members comprising beam members and at least three spaced column members with each said beam member being joined at each of its end faces to a side face of one of said column members by post-tensioned, moment transferring connections, said beam members each having at least one adjustable tension connecting element and at least one compression connecting element on the end faces thereof, said column members each having corresponding tension and compression connecting elements on the side faces thereof for mating with said connecting elements on the end faces of said beam members, said mating connecting compression elements comprising a butt plate secured to the compression bearing surface of the side face of said column members and extending therefrom to engage the compression bearing portion of the end faces of said beam members in unattached abutment to cause a spacing apart of said joined end and side faces at the locations of said mating tension connecting elments and serving as compression fulcrums for unrestricted relative rotation between said joined end and side faces, and said adjustable mating tension connection elements comprising at least one threaded rod attached to the upper portion of each end face of said beam members and extending therefrom through corresponding apertures in the spaced apart side faces of said column members, and secured thereto by nuts, and resistance to said relative rotation comprising only the deadweight of said members and their connections at the other ends of said beam and column members, whereby the tightening of said nuts produces and secures controlled relative rotation about said compression fulcrums between respective pairs of said joined members and tensions and chambers all of said joined beam and column members of said frame structure and renders said connections therebetween capable of immediate moment transfer and said frame structure capable of supportiing vertical and horizontal service loads in rigid frame action.

8. The frame structure according to claim 7, wherein said butt plate comprises the secured upwardly disposed leg of an angle and the other leg of said angle provides vertical support for said beam.

9. A method of constructing a non-bonded, prestressed, rigid frame structure having post-tensioned, post-cambered beam and column members joined by post-tensioned, moment transferring connections, which comprise the steps of:

a. providing beam members having at least one adjustable tension connecting element and at least one compression connecting element extending from the end faces thereof, said tension connecting element comprising at least one threaded rod attached to the upper portion of each end face of said beam members and said compression connecting element comprising a butt plate secured to the lower portion of each end face of said beam members;

b. providing column members having corresponding tension and compression connecting elements on the side faces thereof for forming mating connections with said connecting elements on the end faces of said beam members, said corresponding tension connecting element comprising apertures and said corresponding compression connecting element comprising a compression bearing surface;

c. placing at least three spaced column members;

d. connecting each end face of each said beam member by said connections to the mating connections on a side face of one of said column members;

e. mating said butt plate and said compression bearing surface in each said connection in unattached abutment to cause a spacing apart of said joined end and side faces at the location of said mating tension connecting elements of each said connection and to provide an unrestricted compression fulcrum for unobstructed relative rotation between said joined end and side faces at each of said connections;

f. passing said threaded rod on the end face of each said beam through said corresponding aperture in the spaced apart side face of said column member in each said connection and securing the end thereof by a nut;

g. tightening said nut at each said connection to produce and secure controlled relative rotation between said joined beam and column members about each said compression fulcrum, said relative rotation in each said connection being resisted only by the deadweight of said joined beam member and the connections at the other ends of said beam and column members;

thereby tensioning and cambering all of said joined beam and column members of said frame structure and rendering said connections therebetween capable of immediate moment transfer and said frame structure capable of supporting vertical and horizontal service loads in rigid frame action.

10. A method of constructing a non-bonded, prestressed, rigid frame structure having post-tensioned, post-cambered beam and column members joined by post-tensioned, moment-transferring connections, which comprise the steps of:

a. providing beam members having at least one tension connecting element and at least one adjustable compression connecting element from the end faces thereof, said tension connecting element comprising a tension member fixedly secured to the upper portion of the end face of each said beam member and said compression connecting element comprising at least one threaded rod secured to the lower side of said beam member at the lower edge of each end face thereof and an associated threaded nut which extends from said rod;

b. providing column members having corresponding tension and compression connecting elements on the side faces thereof for forming mating connections with said connecting elements on the end faces of said beam members, said corresponding compression connecting element comprising a compression bearing surface on the side face of said column member;

c. placing at least three spaced column members;

d. connecting each end face of each said beam member by said connections to the mating connections on a side face of one of said column members;

e. fixedly securing the other end of said tension member on the end face of said beam member to the side face of said column member in each said connection to provide an unrestricted tension fulcrum for unobstructed relative rotation between said joined end and side faces at each of said connection;

f. extending one end of said threaded nut at each end face of said beam member to engage said corresponding compression bearing surface on the side face of said column member in each said connection in unattached abutment;

g. turning said threaded nut at each said connection to force apart said joined end and side faces of said beam and column members to produce and secure controlled relative rotation between said joined beam and column members about said tension fulcrums, said relative rotation in each said connection being resisted only by the deadweight of said joined beam member and the connections at the other ends of said beam and column members; thereby tensioning and cambering all of said joined beam and column members of said frame structure and rendering said connections therebetween capable of immediate moment transfer and said frame structure capable of supporting vertical and horizontal service loads in rigid frame action.

11. A non-bonded, prestressed, rigid frame structure providing post-tensioning and resulting camber in all flexural members comprising beam members and at least three spaced column members with each said beam member being joined at its end faces to a side face of one of said column members by post-tensioned, moment-transferring connections, said beam members each having at least one tension connecting element and at least one compression connecting element on the end faces thereof, said column members each having corresponding tension and compression connecting elements on the side faces thereof for mating with said connecting elements on the end faces of said beam members, said mating connecting compression elements comprising at least one protuberance extending from said joined end face of said beam member and engaging the side face of the column member in unattached abutment to cause a spacing apart of said joined end and side faces at the locations of said mating tension connecting elements and serving as compression fulcrums for unrestricted relative rotation between said joined end and side faces, and said mating tension connecting elements comprising individually adjustable fastening means connecting with and between said spaced apart portions of said end and side faces being joined, and resistance to said relative rotation comprising only the deadweight of said members and their connections at the other ends of said beam and column members, whereby the tightening of said adjustable fastening means post-tensions and cambers all of said joined beam and column members of said frame and renders said connections therebetween capable of immediate moment transfer and said frame structure capable of supporting vertical and horizontal service loads in rigid frame action.

12. A non-bonded, prestressed, rigid frame structure providing post-tension and resulting camber in all flexural members comprising beam members and at least three spaced column members with each said beam member being joined at its end faces to a side face of one of said column members by post-tensioned, moment transferring connections, said beam members each having at least one tension connecting element and at least one compression connecting element on the end faces thereof, said column members each having corresponding tension and compression connecting elements on the side faces thereof for mating with said connecting elements on the end faces of said beam members, said mating compression connecting elements comprising individually adjustable force displacement means positioned between and engaging the end face of one said beam member and the side face of one said column member, said mating tension connecting elements comprising a member connecting with and between said mating portions of said end and side faces being joined and forming a tension fulcrum for unobstructed relative rotation between said joined end and side faces, and resistance to said relative rotation comprising only the deadweight of said members and their connections at the other ends of said beam and column members, whereby the activation of said adjustable force displacement means of said compression connecting elements force apart said joined end and side faces to produce and secure relative rotation therebetween about said tension fulcrums and tension and camber all of said joined beam and column members of said frame structure and render said connections therebetween capable of immediate moment transfer and said frame structure capable of supporting vertical and horizontal service loads in rigid frame action.

13. A method of constructing a non-bonded, prestressed, rigid frame structure having post-tensioned, post-cambered beam and column members joined by post-tensioned moment-transferring connections, which comprises the steps of:

a. providing beam and column members, said beam members having at least one adjustable tension connecting element on and at least one compression connecting element extending from the end faces thereof, and said column members each having tension and compression connecting elements on the side faces thereof for forming mating connections with said connecting elements on the end faces of said beam members;

b. placing at least three spaced column members;

c. connecting each end face of each said beam member by said connection to a side face of one of said column members;

d. mating said extending connecting compression elements in each said connection to cause a spacing apart of said joined end and side faces at the location of said mating tension connecting elements of each said connection to provide an unrestricted compression fulcrum for unobstructed relative rotation between said joined end and side faces at each of said connections;

e. mating said adjustable tension connecting elements with and between said spaced apart portions of said end and side faces of said beam and column members being joined in each said connection;

f. tightening said adjustable tension connecting element at each said connection to produce and secure controlled relative rotation between said joined beam and column members about each said compression fulcrum, said relative rotation in each connection being resisted only by the deadweight of said joined beam member and the connections at the other ends of said beam and column members;

thereby tensioning and cambering all of said joined beam and column members of said frame structure and rendering said connections therebetween capable of immediate moment transfer and said frame structure capable of supporting vertical and horizontal service loads in rigid frame action.

14. A method of constructing a non-bonded, prestressed, rigid frame structure having post-tensioned, post-cambered beam and column members joined by post-tensioned, moment-transferring connections, which comprises the steps of:

a. providing beam and column members, said beam members having at least one adjustable compression element on and at least one tension connecting element extending from the end faces thereof, and said column members each having tension and compression connecting elements on the side faces thereof for forming mating connections with said connecting elements on the end faces of said beam members;

b. placing at least three spaced column members;

c. connecting each end face of each said beam member by said connection to a side face of one said column member;

d. mating said extending adjustable compression elements in each said connection, e. mating said tension connecting elements with and between said mating portions of said end and side faces of said beam and column members being joined in each said connection, to provide an unrestricted fulcrum for unobstructed relative rotation between said joined end and side faces at each said connections;

f. tightening said adjustable compression connecting element at each said connection to produce and secure controlled relative rotation between said joined beam and column members about each said tension fulcrum, said relative rotation in each connection being resisted only by the dead-weight of said joined beam member and the connections at the other ends of said beam and column members; thereby tensioning and cambering all of said joined beam and column members of said frame structure and rendering said connections therebetween capable of immediate moment transfer and said frame structure capable of supporting vertical and horizontal service loads in rigid frame action.

* * * * *